US011812801B2

(12) United States Patent
Berryman et al.

(10) Patent No.: US 11,812,801 B2
(45) Date of Patent: Nov. 14, 2023

(54) PROTECTIVE LEG DEVICE AND METHOD

(71) Applicants: Marvin R. Berryman, Sanford, NC (US); Ernest L. Nickerson, Durham, NC (US)

(72) Inventors: Marvin R. Berryman, Sanford, NC (US); Ernest L. Nickerson, Durham, NC (US)

( * ) Notice: Subject to any disclaimer, the term of this patent is extended or adjusted under 35 U.S.C. 154(b) by 0 days.

(21) Appl. No.: 17/393,666

(22) Filed: Aug. 4, 2021

(65) Prior Publication Data

US 2023/0045131 A1 Feb. 9, 2023

(51) Int. Cl.
*A41D 13/05* (2006.01)
*A41D 13/06* (2006.01)

(52) U.S. Cl.
CPC ..... *A41D 13/0543* (2013.01); *A41D 13/0568* (2013.01); *A41D 13/065* (2013.01)

(58) Field of Classification Search
CPC ..... A41D 13/0543; A41D 13/0568; A41D 13/065
See application file for complete search history.

(56) References Cited

U.S. PATENT DOCUMENTS 2,717,387 A * 9/1955 McMahan ..... A41D 13/0568 2/22
2,733,443 A * 2/1956 Holder ..... A41D 13/0568 2/22
3,128,565 A * 4/1964 Graham ..... A41D 17/02 2/242
5,611,080 A * 3/1997 Skottheim ..... A63B 71/1225 2/22
5,634,215 A * 6/1997 DeBaene ..... A41D 1/067 2/69
5,970,525 A * 10/1999 Gallinot ..... A41D 13/0568 2/22
6,298,484 B1 * 10/2001 Beckman ..... A63B 71/1225 2/22
8,510,862 B1 * 8/2013 Contant ..... A63B 71/1225 2/22
8,608,138 B2 12/2013 Cooke
9,149,709 B1 * 10/2015 Schuster ..... A63B 71/081
9,622,521 B1 * 4/2017 Clayton ..... A41D 13/0543
2001/0044947 A1 * 11/2001 Heller ..... A41D 13/06 2/22
2002/0162153 A1 * 11/2002 Collins ..... A41D 13/0568 2/22
2003/0024029 A1 * 2/2003 Fiorini ..... A41D 13/065 2/22
2007/0250977 A1 * 11/2007 Brown ..... A63B 71/1225 2/22
2008/0040838 A1 * 2/2008 Watley ..... A41D 17/00 2/242

(Continued)

OTHER PUBLICATIONS

Raynbird Limited, Turn Greywater Into Clean Water !, Aloaqua, 2021, https://aloaqua.wordpress.com, Accessed Mar. 24, 2021.

*Primary Examiner* — Katharine G Kane
(74) *Attorney, Agent, or Firm* — James G. Passe; Passe Intellectual Property, LLC

(57) ABSTRACT

A protective leg device and method designed to keep a user's legs clean while kneeling or standing on the ground or floor when engaging in activities such as gardening, grouting, landscaping, construction, and the like and which provides comfort while salvaging a user's pair of pants.

4 Claims, 3 Drawing Sheets

(56) References Cited

U.S. PATENT DOCUMENTS

2008/0120756 A1* 5/2008 Shepherd ..... A41D 13/0568 2/22
2009/0282609 A1* 11/2009 Kotoske ..... A41D 13/0562 2/463
2010/0192269 A1* 8/2010 Saranga ..... A41D 13/0568 2/24
2010/0319098 A1* 12/2010 Watt ..... A41D 17/00 2/22
2012/0180183 A1* 7/2012 Mechling ..... A63B 71/1225 2/22
2013/0025017 A1* 1/2013 Chen ..... A41D 13/0543 2/22
2013/0283491 A1* 10/2013 Clement ..... A63B 69/004 2/22
2014/0259259 A1* 9/2014 Smith ..... A43B 5/18 2/22
2015/0033433 A1* 2/2015 Mackey ..... A63B 69/0026 2/22
2015/0047090 A1* 2/2015 Cook ..... A41D 13/0543 2/22
2016/0183609 A1* 6/2016 Cox ..... A41D 13/0568 2/22
2017/0055603 A1* 3/2017 Guidetti ..... A41D 13/0543
2017/0144892 A1 5/2017 McCluskey et al.
2018/0214764 A1* 8/2018 Reixachs Ferrer ... B32B 27/065
2018/0292177 A1* 10/2018 Roby ..... A41D 13/0512
2018/0326290 A1* 11/2018 Rodrick ..... A63B 71/1225
2019/0192954 A1* 6/2019 Runzo ..... A63B 71/1225
2019/0231003 A1* 8/2019 Morris ..... A41D 13/065
2019/0364990 A1* 12/2019 LaCroix ..... A41D 13/0543
2020/0138125 A1* 5/2020 Beaudry ..... A41D 13/0153
2020/0268069 A1* 8/2020 Foster ..... A41D 13/0543
2020/0391096 A1* 12/2020 Gauvin ..... A63B 71/1225
2021/0100298 A1* 4/2021 Levesque ..... A41D 31/245

* cited by examiner

PROTECTIVE LEG DEVICE AND METHOD

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a protective leg device and method of use. In particular, it relates to a protective leg design that keeps the user's pants and legs clean while kneeling, standing, or otherwise lying on the ground or floor.

Description of Related Art

Many jobs require an individual to be on their knees, standing, or lying on the ground for cleaning a dirty floor or dirty surface, grouting floor tiles, gardening, painting baseboards, or other surface jobs, construction, and the like, that can soil an individual's pants or legs or even leave them permanently stained, and thus requiring disposal. An individual's knees and/or legs can become wounded without protection. Likewise, pants can become soiled in these situations due to dirt on the surface or floor, from wet materials being used such as grout, grout paint, painting, and dirt or mud while gardening or doing construction.

There are a number of ways people try to overcome these situations. One way is to have a dedicated pair of pants for the activity, especially when an activity is repeated, such as with gardening, painting, construction, and the like. However, these dedicated pants get dirty and can be unsalvageable with the only benefit being that it keeps a good pair of pants from being ruined. Another approach is a kneeler device, where the user kneels on the device rather than on the ground. The problem with this approach is that they are expensive and the only part of the leg that is protected is the knee. A third approach is the use of a shin guard. However, shin guards have hard plastic that is positioned over the shin of a user and only covers the front of the leg below the knee and above the ankle. The hard plastic over the shin is designed to protect the shin from impact (e.g., from a baseball, or the like) and is neither designed for comfort nor to protect the entire lower leg of the user. Accordingly, there needs to be a better and more comfortable solution to keep the pants and legs of an individual clean while kneeling, standing, lying down, and the like.

BRIEF SUMMARY OF THE INVENTION

The present invention relates to a device and method for protecting the pants and legs of a user while engaged in activities that would ruin regular pants.

Accordingly, in one embodiment, there is a lower leg protection device for a user comprising:

a) a hard knee protector;
b) a hard protector covering one or more of the ankles and instep;
c) padded, soft material covering a front of the user's lower leg between the hard knee protector and the ankle and instep protector;

d) a covering for a back of the lower leg; and
e) a device for attaching the lower leg protection device to the user's lower leg.

In another embodiment, there is a method to provide lower leg protection for a user comprising:

a) selecting a device comprising:
   i. a hard knee protector;
   ii. a hard protector covering one or more of the ankles and instep;
   iii. padded, soft material covering a front of the user's lower leg between the hard knee protector and the ankle and instep protector;
   iv. a covering for a back of the lower leg; and
   v. a device for attaching the lower leg protection device to the user's lower leg; and
b) attaching the device to a lower leg of a user.

DETAILED DESCRIPTION OF THE INVENTION

Figure 1:
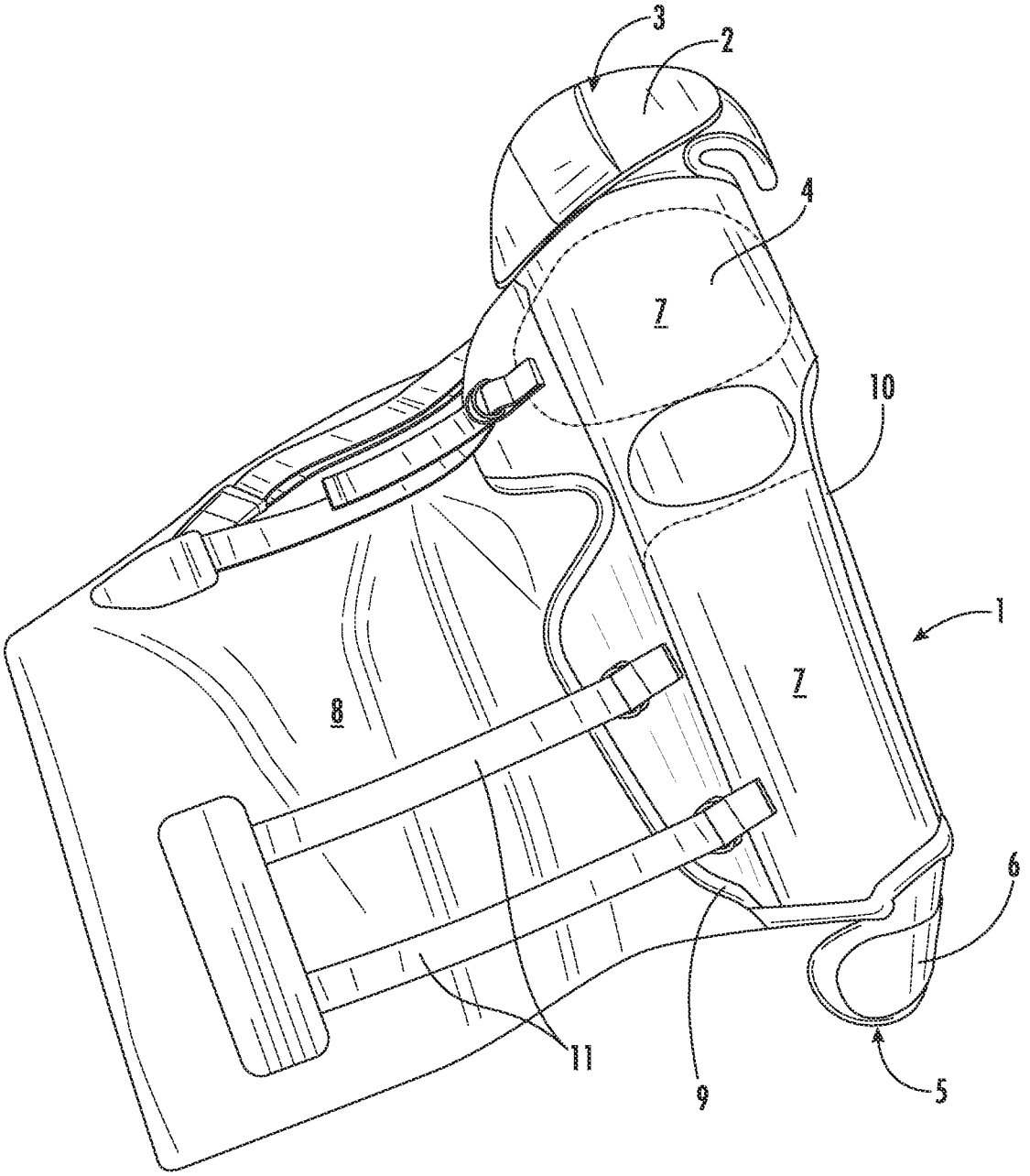
FIG. 1 is a frontal, perspective view of the lower leg protection device of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "lower leg" refers to the part of the leg from (and including) the knee down to the ankle or instep, depending on the lower leg length, and if the pants are worn underneath. It includes not just the front of the lower leg, but also the back of the entire lower leg.

As used herein, the term "lower leg protection device" refers to a device that protects the knee, ankle, and instep, and a covering that covers the remainder of the lower leg in a manner that no part of the lower leg is exposed. This way it can't be soiled by dirt, paint, grout, or the like.

As used herein, the term "user" refers to a person wearing a pair of pants, shorts, or no pants, who is going to do an activity which might soil or damage some portion or all of the lower leg, either the front or the back. Examples of such activities that may require kneeling would include gardening, floor washing, grouting floors, tiling floors, and painting the lower part of a wall. Examples of standing include landscaping, construction, and farming.

As used herein, the term "hard protector covering one or more of the ankles and instep" refers to a hard covering or cap such as a high-density plastic, nylon/resin, other polymers, and the like that can resist impact. Such protectors hang on the front of a user's leg draping over the ankle and/or instep. They are shaped to essentially lie across the ankle or instep in order to protect these areas from impact from an object or from hitting something while kneeling, and the like. If desired, they can fit to wear over pants.

As used herein, the term "hard knee protector" refers to a hard covering or cap such as a high-density plastic, nylon/resin, other polymers, and the like, that can resist impact. The hard knee protector rests on the top of the knee to protect it from impact, or the like.

As used herein, the term "padded, soft material" refers to a material like a cloth (e.g., denim), that has some padding, batting, or the like behind it and is designed to soften the front of the leg when the user is in the kneeling, standing, or lying down position.

As used herein, the term "covering for a back of the lower leg" refers to material, either padded or not, that wraps around the back of the leg, such that no part of the lower leg is exposed.

As used herein, the term "device for attaching the lower leg device to the leg" refers to a device that holds the lower leg device in place on the user's leg. In one embodiment, shown in the figures, one or more straps are wrapped around the leg holding the front and back portions of the lower leg device in place on the leg of a user. Other options include sewing the device shut, but making the back material a stretchy material so it can be slipped on the leg. Other attachments include hook and loop fasteners, snaps, buttons, and the like.

DRAWINGS

Now referring to the drawings, FIG. 1 is a frontal perspective view of the lower leg protection device 1 of the present invention, not mounted on a lower leg. In this view, we see hard knee protector 2 at a top 3 of the front 4 of the protection device. At a bottom 5 of the protection device 1, is a hard protector for covering one or more of the ankles and instep 6 of the user. In-between the hard knee protector 2 and hard ankle/instep protector 6 is a padded, soft material 7 comprising cloth (denim, and padded with rubber), and is designed to cover the front of the lower leg. Attached to a first side 9 of front padded, soft material 7 is covering for the back of the lower leg 8, which in use, wraps around the back of the lower leg and attaches to an opposite side 10 of front padded, soft material 7 and attaches by any means such as snaps, buttons, hooks, loop fasteners, straps 11, and the like.

Figure 2:
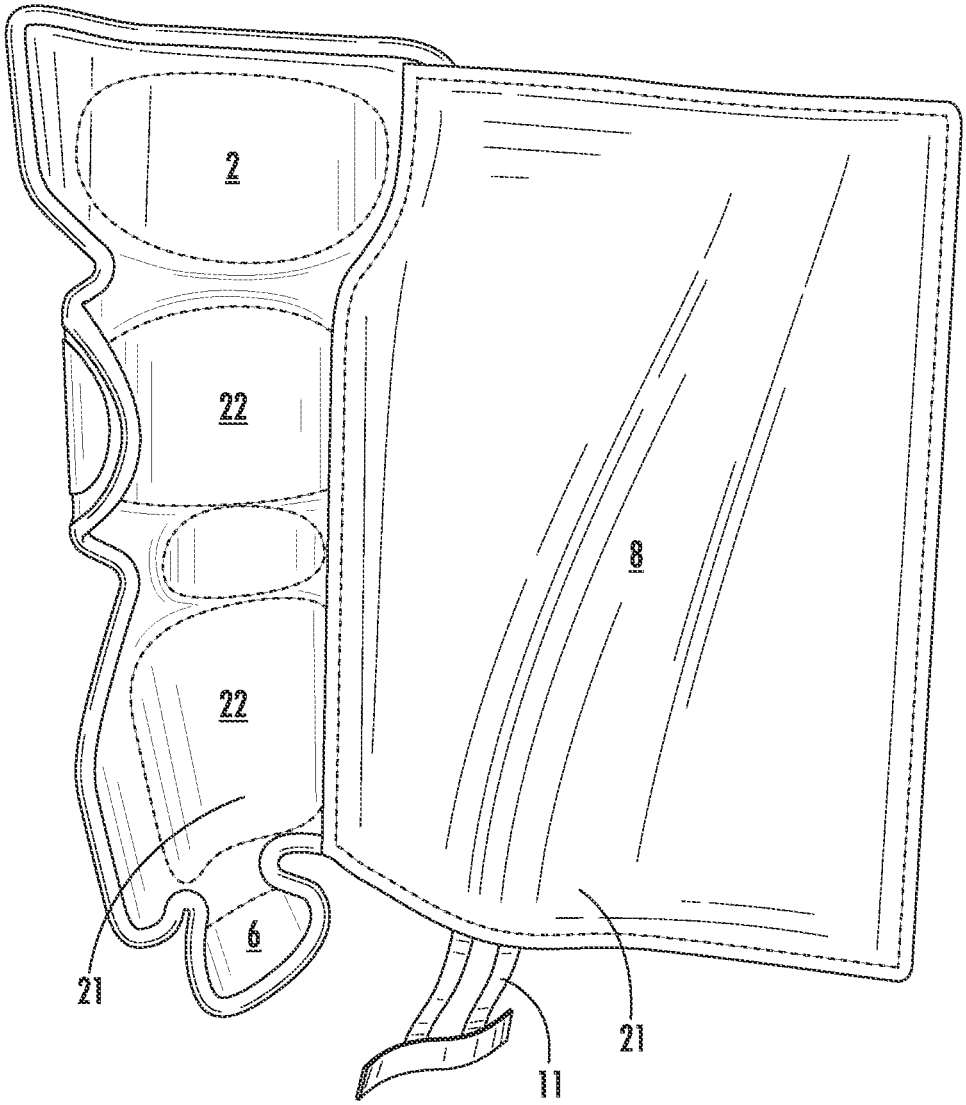
FIG. 2 is a side perspective view of the device that touches the lower leg of a user of the present invention.

FIG. 2 shows the side of device 1 that touches the lower leg, i.e., the back 21. In this view, we see that the hard knee protector 2 and hard ankle/instep protector 6 is padded 22 since it rests against the user.

Figure 3:
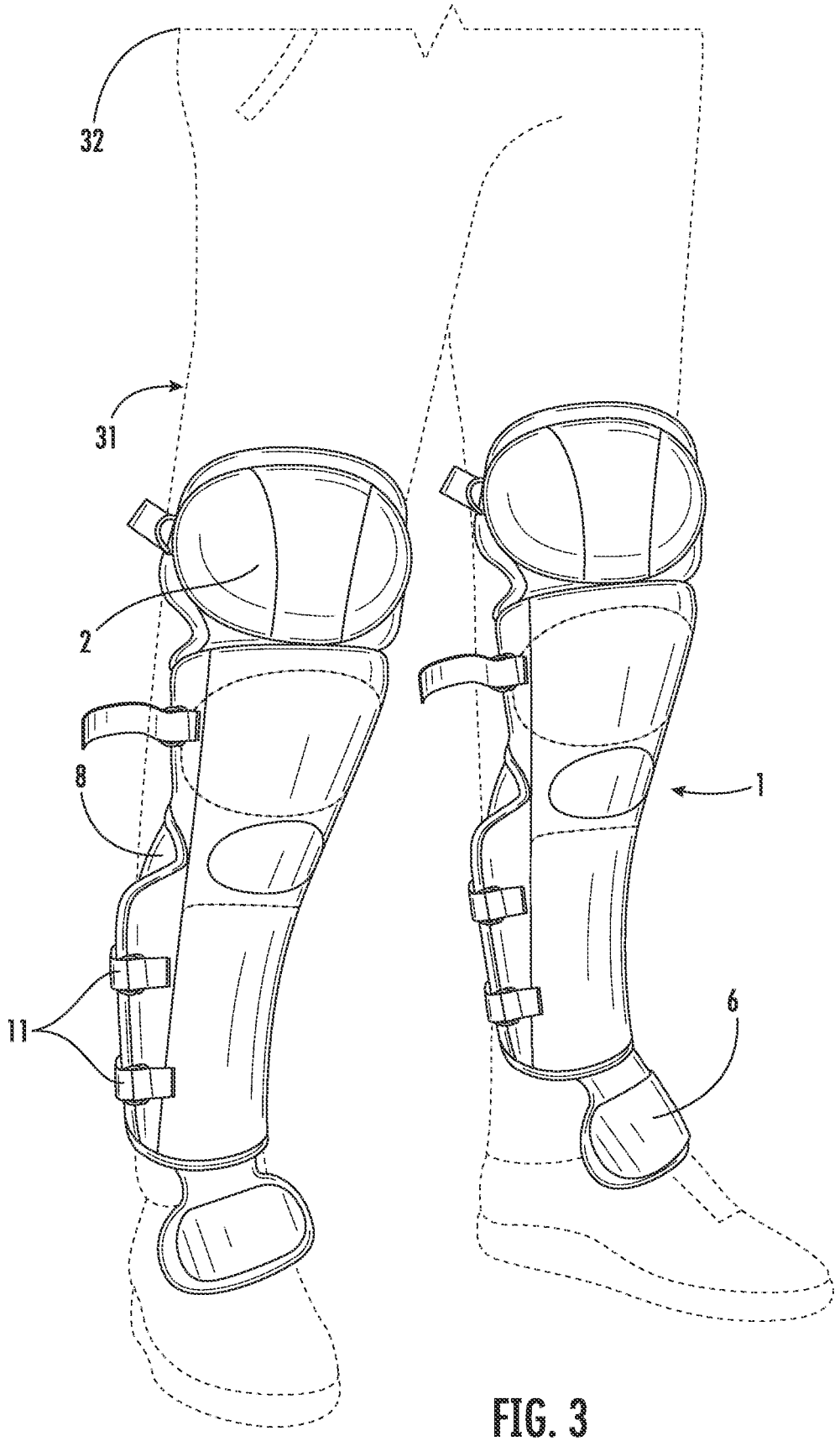
FIG. 3 is a perspective view of the device of the present invention, mounted onto the lower leg of a user.

FIG. 3 shows the lower leg protection device 1 mounted on the lower leg 31 of user 32. In this view, the lower leg protection device 1 is wrapped entirely around the lower leg 31 of user 32, thus preventing that part of the legs from being soiled.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A one-piece lower leg soiling protection device for attachment to a user's leg while engaging in an activity which might soil the lower leg consisting of:

a) a hard knee protector;

b) a hard protector covering one or more of the ankles and instep;

c) padded, soft material covering the entire lower front of the user's leg between the hard knee protector and the ankle and instep protector;

d) a soft material for a back of the lower leg which covers the back of the entire lower leg in a manner to keep the lower leg from being soiled; and e) a device for attaching the lower leg soiling protection device to the user's lower leg.

2. The lower leg soiling protection device according to claim 1, wherein the device for attaching is a plurality of straps.

3. The lower leg soiling protection device according to claim 1, wherein the padded soft material is denim.

4. A method to provide lower leg soiling protection for a user engaging in an activity which might soil the lower leg comprising:

a) selecting a one-piece device for attachment to a user's leg consisting of:
   i. hard knee protector;
   ii. a hard protector covering one or more of the ankles and instep;
   iii. padded, soft material covering the entire front of the user's lower leg between the hard knee protector and the ankle and instep protector;
   iv. a soft material for a back of the lower leg which covers the back of the entire lower leg in a manner to keep the lower leg from being soiled; and
   v. a device for attaching the one piece lower leg soiling protection device to the user's lower leg; and b) attaching the device to a lower leg of a user engaging in an activity which might soil the lower leg.

* * * * *